US009999919B2

(12) United States Patent
Murakami et al.

(10) Patent No.: US 9,999,919 B2
(45) Date of Patent: Jun. 19, 2018

(54) METHOD FOR OPERATING CONTINUOUS CASTING MACHINE

(71) Applicant: NIPPON STEEL & SUMITOMO METAL CORPORATION, Tokyo (JP)

(72) Inventors: Toshihiko Murakami, Kashima (JP); Shinsuke Watanabe, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days. days.

(21) Appl. No.: 15/312,678

(22) PCT Filed: May 26, 2015

(86) PCT No.: PCT/JP2015/065085
§ 371 (c)(1),
(2) Date: Nov. 21, 2016

(87) PCT Pub. No.: WO2015/198778
PCT Pub. Date: Dec. 30, 2015

(65) Prior Publication Data

US 2017/0182550 A1 Jun. 29, 2017

(30) Foreign Application Priority Data

Jun. 27, 2014 (JP) ..... 2014-132848

(51) Int. Cl.
*B22D 11/051* (2006.01)
*B22D 11/041* (2006.01)

(52) U.S. Cl.
CPC ..... *B22D 11/051* (2013.01); *B22D 11/041* (2013.01)

(58) Field of Classification Search
CPC ... B22D 11/051; B22D 11/053; B22D 11/166; B22D 11/114
See application file for complete search history.

(56) References Cited

FOREIGN PATENT DOCUMENTS

| | | |
|---|---|---|
| JP | 02-197359 | 8/1990 |
| JP | 04-79744 | 12/1992 |
| JP | 3651447 | 5/2005 |

*Primary Examiner* — Kevin P Kerns
*Assistant Examiner* — Steven S Ha
(74) *Attorney, Agent, or Firm* — Clark & Brody

(57) ABSTRACT

A primary object of this invention is to provide a method for operating a continuous casting machine with which a mold can oscillate with a predetermined oscillation waveform since the start of operation of an oscillator. This invention is a method for operating a continuous casting machine, the method comprising: withdrawing a slab from a mold while vertically oscillating the mold with an oscillation waveform represented by the following formula (1) by selecting a value of φ according to a value of b so that the following formula (1) satisfies r(0)=0:

$$r(t)=(S/2)\{\sin(\omega t+\varphi)+b\cos 2(\omega t+\varphi)+b\} \quad (1)$$

where r(t): displacement of the mold (mm), S: vibration stroke of the mold S (mm), ω: angular velocity (=2πf) (rad/s), f: oscillation frequency of the mold (Hz), t: time(s), φ: initial phase (°), and b: non-sine coefficient (0<b≤0.25).

2 Claims, 6 Drawing Sheets

METHOD FOR OPERATING CONTINUOUS CASTING MACHINE

TECHNICAL FIELD

This invention relates to a method for operating a continuous casting machine used for continuous casting, and specifically, related to a method for operating a continuous casting machine of oscillating a mold.

BACKGROUND ART

Continuous casting of steel is carried out in such a way that: molten steel is poured from a ladle via a tundish into a mold; and after a solidified shell forms in the mold, a slab including an unsolidified area is withdrawn downward underneath the mold. When a continuous casting machine is operated, especially when molten steel is cast at high speed, there is a case where part of the solidified shell is constrained from being withdrawn by stick on an inner wall of the mold and this constrained part functions as a hindrance to formation of a normal solidified shell. In this case, not only various faults but also breakout might occur in products.

Conventionally, powder to be put into molten steel in a mold is selected to deal with this problem. Molten powder floats and spreads over the surface of the molten steel, is supplied to a space between the mold and the solidified shell, and functions as a lubricant reducing frictional force between them. Whereby, stick of the solidified shell on the inner wall of the mold can be suppressed in some degree.

However, in recent years, operation of continuous casting has been applied for various kinds of steel grades, and carried out under various casting conditions. Therefore, there is a limit if physical properties of powder are changed to deal with such various situations. Thus, such a method is tried that a mold is oscillated at the same time when powder is put. Proper oscillation of the mold makes it possible to suppress stick in the mold.

Patent Literature 1 discloses applying, to a casting mold, vertical oscillation, having a deviated sine waveform that is deviated from a sine waveform. Patent Literature 1 gives the following formula (X) as a specific deviated sine waveform:

$$Z=a_1 \sin 2\pi ft+a_2 \sin 4\pi ft+a_3 \sin 6\pi ft \quad (X)$$

where Z is displacement of the mold (mm), $a_1$, $a_2$, $a_3$, . . . are amplitude (mm), f is oscillation frequency of the mold (cycles/s) and t is time(s).

According to Patent Literature 1, oscillation having the waveform represented by the above formula (X) is controlled so that:

(i) the maximum descending speed of the mold during negative strip time is fast;

(ii) the maximum ascending speed of the mold during positive strip time is slow;

(iii) the negative strip time is short; and (iv) the positive strip time is long, compared to the case where the oscillation waveform is a sine wave.

The negative strip time is time when the descending speed of the mold is faster than the withdrawal rate of an unsolidified slab. The positive strip time is time when the speed of the mold is slower than the withdrawal rate of the unsolidified slab. According to Patent Literature 1, meeting the requirements of the above (i) to (iv) makes it possible to increase the inflow of molten powder into a space between the mold and the solidified shell and to suppress occurrence of breakout.

However, in the method of Patent Literature 1, the movement of the mold suddenly changes from the ascent to the descent upon the oscillation of the mold. At this time, molten powder adhered in the vicinity of meniscus in the mold and unmolten powder are involved in molten steel. Whereby, the surface quality of a slab deteriorates and/or troubles on the operation occur depending on a type of powder used.

Conventionally, an oscillator including an electric motor and an eccentric cam is used for oscillating a mold. A desired oscillation waveform is obtained according to a shape of an eccentric cam. In this case, an eccentric cam corresponding to an oscillation waveform has to be prepared for changing the oscillation waveform. In recent years, an electro-hydraulic oscillator has been used for oscillating a mold, which has made it easy to change parameters when a mold is oscillated with complex waveforms as disclosed in Patent Literature 1 and Patent Literature 2 below.

Patent Literature 2 discloses the method for operating a continuous casting machine comprising vertically vibrating a mold with the waveform expressed by the formula (Y) below:

$$Z=A(\sin 2\pi ft+b \cos 4\pi ft+c) \quad (Y)$$

where Z is displacement of the mold (mm), A is ½ of a vibration stroke S of the mold (mm), b is strain constant, c is strain constant, f is vibration frequency of the mold (Hz/60) and t is time(s).

According to Patent Literature 2, employment of such a vibration waveform makes it possible that abrupt change in the mold from an ascent to a descent does not occur, and molten and unmolten powder are not involved in molten steel.

When such a vibration waveform is employed, a neutral position of the oscillation shifts to either upper or lower side. In this case, symmetry of the oscillation is secured in vertical type continuous casting, in which a path where an unsolidified slab travels in a mold is in a perpendicular direction. On the contrary, in curved type continuous casting, in which a path where an unsolidified slab travels in a mold curves, symmetry of oscillation is broken, and such a problem tends to be arose like poor lubrication in the mold and involvement of powder into molten steel.

If the above vibration waveform in Patent Literature 2 is employed, the displacement Z at the time t=0 is not 0 but SC/2. In this case, a mold cannot oscillate with a predetermined oscillation waveform at the start of operation of an oscillator that oscillates the mold, and the mold is displaced step by step as time passes, for example. This disables a dummy bar, which seals an opening in the bottom side of the mold at the start of casting, to seal an opening enough, and molten steel might leak out of the mold.

CITATION LIST

Patent Literature

Patent Literature 1: Japanese Examined Patent Application Publication No. H4-79744

Patent Literature 2: Japanese Patent No. 3651447

SUMMARY OF INVENTION

Technical Problem

An object of this invention is to provide a method for operating a continuous casting machine with which poor lubrication and involvement of powder into molten steel due to the above problems of the prior arts, especially due to the shift of a neutral position in curved type continuous casting can be prevented.

Another object of this invention is to provide a method for operating a continuous casting machine with which troubles at the initial stage of casting (like seal leakage) can be prevented, and with which a mold can oscillate with a predetermined oscillation waveform since the start of operation of an oscillator.

Solution to Problem

The essentials of this invention include the following method for operating a continuous casting machine:

A method for operating a continuous casting machine where a slab is withdrawn from a mold for continuous casting while the mold is oscillated in a vertical direction, the method comprising:

oscillating the mold so as to satisfy the following formula (2) with an oscillation waveform represented by the following formula (1):

[Math. 1]

$$r(t) = (S/2)\{\sin(\omega t + \varphi) + b\cos 2(\omega t + \varphi) + b\} \quad (1)$$

$$\varphi = \pm\tan^{-1}\left\{\frac{1}{\sqrt{2}}\sqrt{(1+16b^2)-1}\right\} \quad (2)$$

wherein r(t) is displacement of the mold (mm),
S is an oscillation stroke of the mold (mm),
ω is angular velocity (=2πf) (rad/s),
f is oscillation frequency of the mold (Hz),
t is time(s).
φ is the initial phase (rad), and
b is a non-sine coefficient (0<b≤0.25).

Advantageous Effects of Invention

According to the operation method of this invention, a mold oscillates with an oscillation waveform represented by the above formula (1). A neutral position does not shift with the oscillation waveform represented by the above formula (1) in curved type continuous casting. Therefore, poor lubrication and involvement of powder into molten steel can be prevented.

Satisfaction of the above formula (2) makes the displacement of a mold 0 when r(0)=0, that is, at the start of operation of an oscillator. Therefore, the mold can oscillate with a predetermined oscillation waveform since the start of operation of the oscillator, and thus, troubles at the initial stage of casting can be prevented.

DESCRIPTION OF EMBODIMENTS

Figure 1:
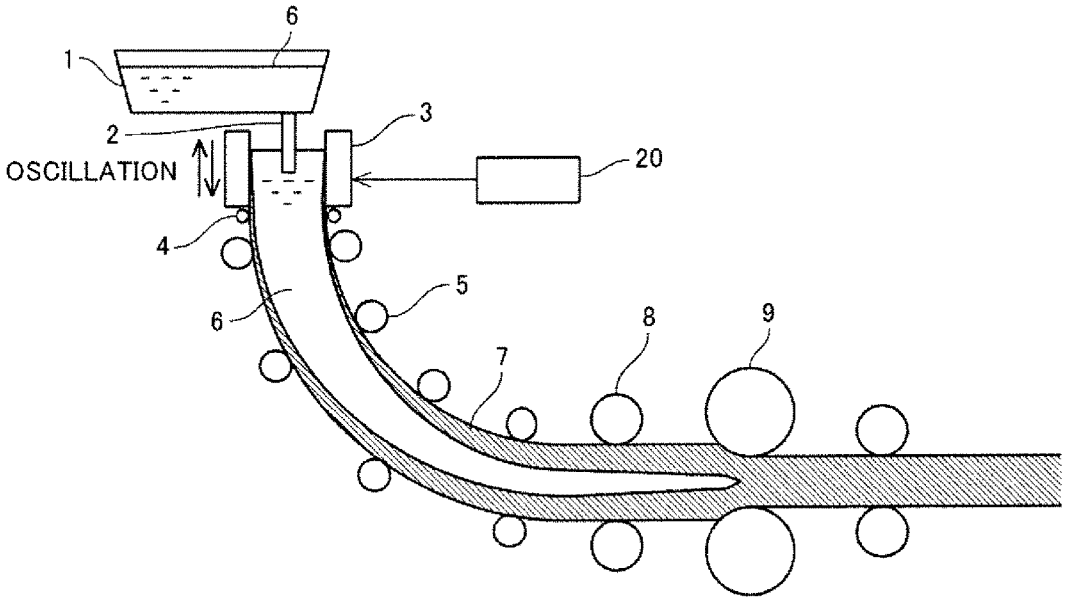
FIG. 1 is a cross sectional view showing an example of the structure of a continuous casting machine to which the operation method of this invention can be applied.

FIG. 1 is a cross sectional view showing an example of the structure of a continuous casting machine to which the operation method of this invention can be applied. A tundish 1 is stocked with molten steel 6 supplied from a ladle not shown. A tubular mold 3 having an opening at each top and bottom thereof is arranged below the tundish 1. The molten steel 6 is poured from the tundish 1 via the immerged nozzle 2 into the mold 3 through the opening at the top of the mold 3.

An oscillator 20 is connected to the mold 3. The oscillator 20 is electro-hydraulic, and can vertically oscillate the mold 3. The oscillator 20 includes a controlling part. Parameters of waveforms can be inputted to the controlling part. The oscillator 20 can generate oscillation having various waveforms based on inputted parameters. Oscillation having a waveform generated by the way described above is applied to the mold 3 during continuous casting.

Powder is put into the molten steel 6 in the mold 3. Powder melts with heat of the molten steel 6, to become molten powder, and spreads over the surface of the molten steel 6 in the mold 3. In the molten steel 6, a contact portion with or a portion in the vicinity of a part facing the mold 3 are cooled, solidified, to be a tubular solidified shell 7. The molten powder is supplied to a space between the mold 3 and the solidified shell 7. Whereby, frictional force between the mold 3 and the solidified shell 7 is decreased.

The inside of the solidified shell 7 is filled with the molten steel 6. The molten steel 6 is not completely solidified by passing through the mold 3, to be an unsolidified slab including an unsolidified part. The unsolidified slab is cooled by cooling water jetted out of secondary cooling spray nozzles arranged below the mold 3, which are not shown. Whereby, the solidified shell 7 enlarges.

As being supported by foot rolls 4 arranged right under the mold 3 and plural of roller aprons 5 arranged in the downstream side of the foot rolls 4 in the direction where the unsolidified slab travels (hereinafter just referred to as "downstream side"), the unsolidified slab is withdrawn by pinch rolls 8 arranged in the downstream side of the roller aprons 5. The unsolidified slab is reduced by reduction rolls 9 arranged in the downstream side of the pinch rolls 8, to be a slab that does not substantially contain any unsolidified part.

As described above, in the method for operating a continuous casting machine of this invention, the mold oscillates with the oscillation waveform represented by the formula (1). While the waveform of the formula (X) in the prior art is a composite waveform that is the combination of only sine waves of different cycles, the waveform of the formula (1) is a composite waveform of a sine wave and a cosine wave. Further, the formula (1) is significantly different from the formula (X) in introduction of the initial phase φ and r(0)=0.

In the formula (1), let φ=0. The displacement of the mold r(t) is the maximum value (S/2) when ωt=π/2, and is the minimum value (−S/2) when ωt=−π/2. The maximum value and the minimum value of the displacement of the mold r(t) do not depend on the initial phase φ. Thus, a neutral position does not shift in the oscillation waveform represented by the formula (1). Therefore, poor lubrication and involvement of powder into the molten steel can be prevented not only in vertical type continuous casting but also curved type continuous casting.

The formula (3) below has to be satisfied in order for the displacement of the mold to be 0 when the time t=0. The formula (3) below is obtained by substituting 0 for t, to be r(0)=0 in the formula (1):

$$0=\sin\varphi+b\cos 2\varphi+b \quad (3)$$

Using the formula of a trigonometric function, $\cos 2\varphi=1-2\sin^2\varphi$, the formula (3) can be rewritten into the formula (4) below:

$$2b\sin^2\varphi-\sin\varphi-2b=0\ (b>0) \quad (4)$$

Since $|\sin\varphi|\leq 1$, the following formula (5) is obtained if $\sin\varphi$ is made to be the subject of the formula (4):

$$\sin\varphi=\{1-(1+16b^2)^{1/2}\}/4b \quad (5)$$

If φ is made to be the subject of the formula (5) using the formulae of a trigonometric function, $\tan\varphi=\sin\varphi/\cos\varphi$ and $\cos\varphi=\pm(1-\sin^2\varphi)^{1/2}$, the above formula (2) is obtained.

That is, satisfaction of the formula (2) makes the displacement of the mold r(0) 0 when the time t=0. Therefore, it becomes possible to oscillate the mold with a predetermined oscillation waveform since the start of operation of the oscillator that oscillates the mold, and to well seal the opening of the mold with a dummy bar.

Two values of φ are determined by the formula (2). If a direction of the movement of the mold at the start of oscillation is upward, φ that satisfies $\cos\varphi>0$ may be employed since $dr(0)/dt>0$.

A non-sine coefficient b is any value within the range of $0<b\leq 0.25$.

Figure 2:
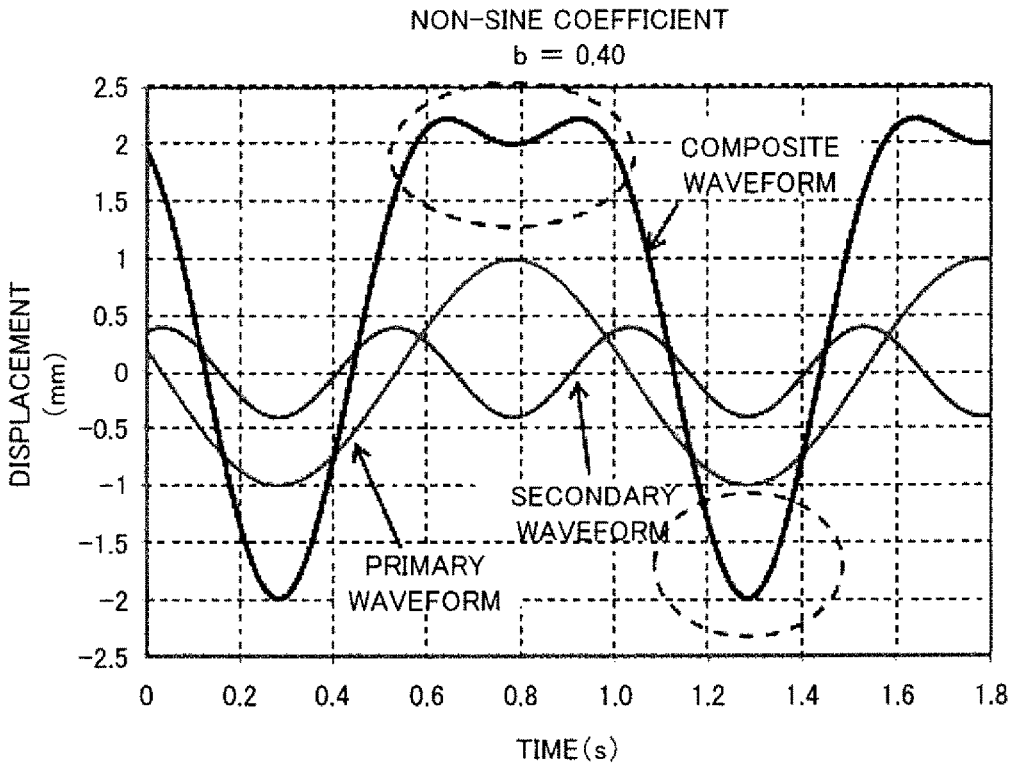
FIG. 2 shows oscillation waveforms when b=0.40 and φ=−33.66° (oscillation waveforms of Reference Example).

"b" is a coefficient of $\cos 2(\omega t+\varphi)$ in the term of $b\cos 2(\omega t+\varphi)$, and determines magnitude of the term of $b\cos 2(\omega t+\varphi)$ to the term of $\sin(\omega t+\varphi)$. In a case of $0.25<b$, the term of $b\cos 2(\omega t+\varphi)$ is too large compared to the term of $\sin(\omega t+\varphi)$, which arises a problem that the mold descends when $\omega t+\varphi=\pi(1/2+2n)$ (n is 0 or a positive integer), where the mold should ascend most. Thus, $b\leq 0.25$. For your reference, FIG. 2 shows the waveforms when b=0.4 and the initial phase φ=−33.66°. As shown in FIG. 2, in the case of b=0.4 that satisfies $0.25<b$, the mold descends when $\omega t+\varphi=\pi(1/2+2n)$ (n is 0 or a positive integer), where the mold should ascend most. Therefore, in this invention, $b\leq 0.25$.

On the other hand, when b is 0, the waveform of the displacement of the mold r(t) shows simple harmonic motion. In this case, compared with the case of $0<b$, the inflow of the molten powder into a space between the mold and the solidified shell cannot be increased. Thus, in this invention, $0<b$. Preferably $0.15\leq b$ in this invention in order to increase the inflow of the molten powder enough compared with the case of the simple harmonic motion.

Table 1 shows values of the initial phase φ determined by the formula (2) in each case where the non-sine coefficient b is 0.15, 0.20 and 0.25. It makes r(0)=0 possible that a value of the initial phase φ that satisfies the formula (2) is employed according to a value of the non-sine coefficient b.

TABLE 1

| Non-sine Coefficient (b) | 0.15 | 0.20 | 0.25 |
|---|---|---|---|
| Initial Phase (φ) | −16.08 | −20.535 | −24.46 |

Figure 3:
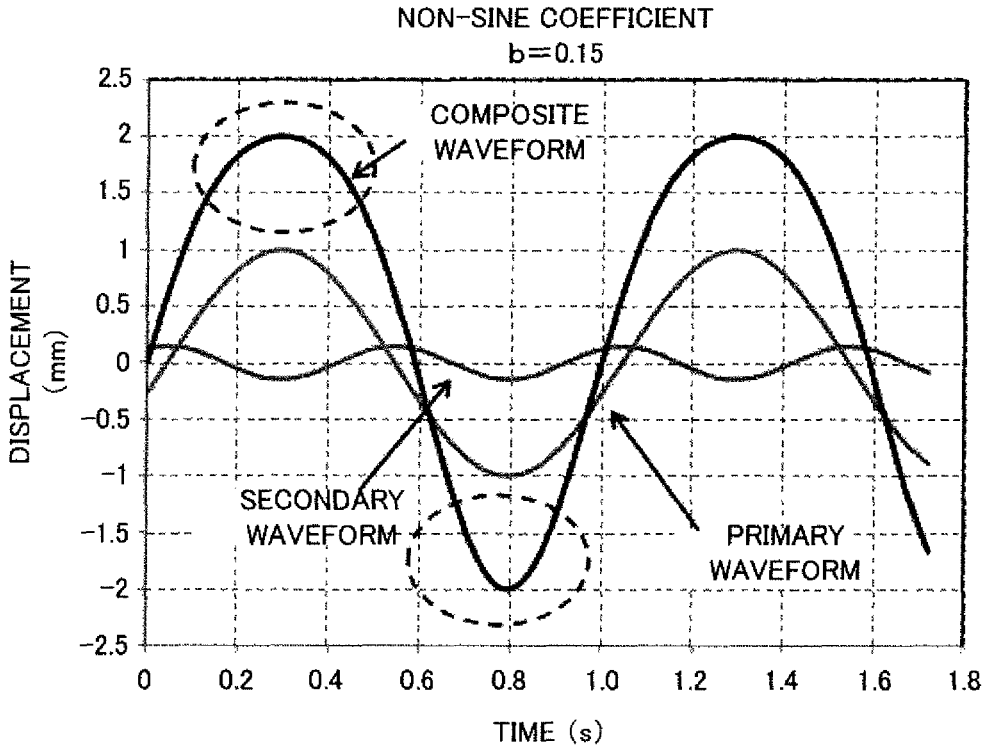
FIG. 3 shows oscillation waveforms when b=0.15 and φ=−16.08° in this invention.
Figure 4:
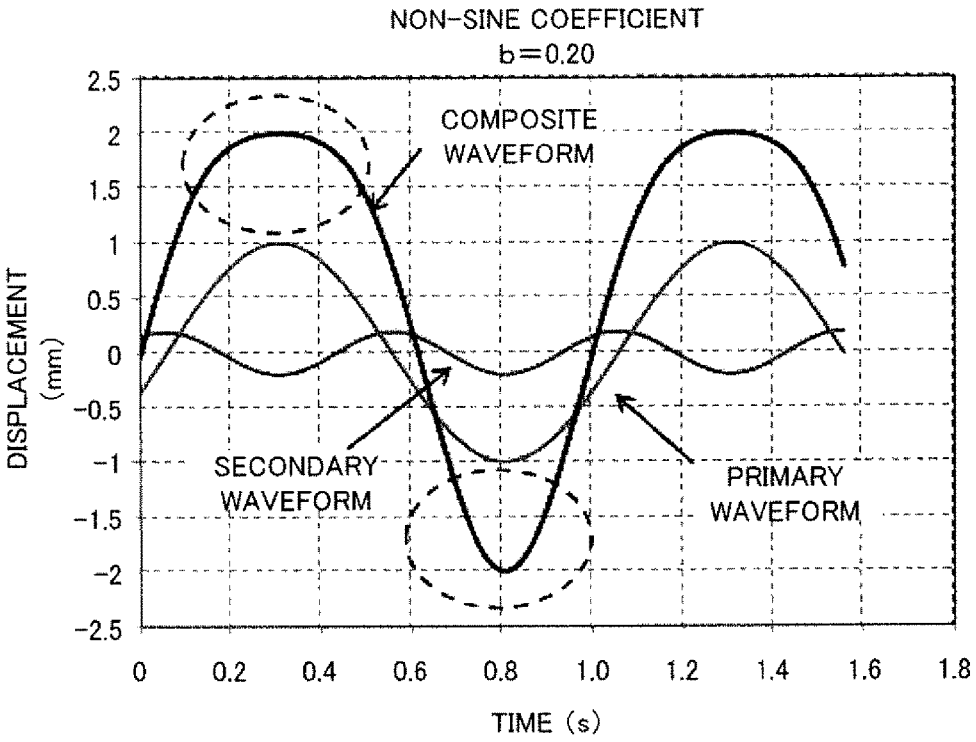
FIG. 4 shows oscillation waveforms when b=0.20 and φ=−20.535° in this invention.
Figure 5:
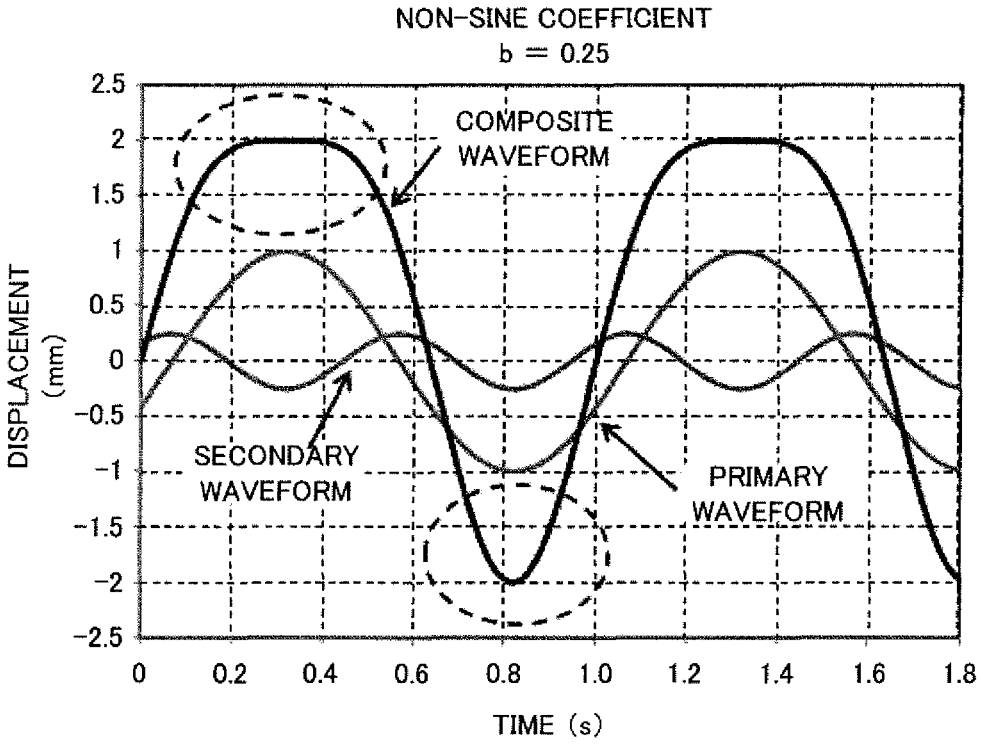
FIG. 5 shows oscillation waveforms when b=0.25 and φ=−24.46° in this invention.

FIGS. 3 to 5 show waveforms based on the formula (1) (relation between the time t and the displacement of the mold r(t)) when the combination shown in Table 1, that is, (b=0.15, φ=−16.08°), (b=0.20, φ=−20.535°), (b=0.25, φ=−24.46°) are employed as values of the non-sine coefficient b and the initial phase φ.

In FIGS. 3 to 5, the part of $\sin(\omega t+\varphi)$ in the formula (1) is shown as a primary waveform, the part of $b\cos 2(\omega t+\varphi)$ therein is shown as a secondary waveform, and r(t) therein is shown as a composite waveform, where S=4 mm and $\omega=2\pi$rad/s.

In each composite waveform shown in FIGS. 3 to 5, change in movement speed in the vicinity of the maximum displacement (peak) is small, and that in the vicinity of the minimum displacement (bottom) is large compared to the case where an oscillation waveform is a sine wave. As the non-sine coefficient b is larger, time when the change in movement speed in the vicinity of the maximum displacement is small is longer. The movement speed of the mold (ascending speed and descending speed) is fast during the time between the vicinity of the minimum displacement and the vicinity of the maximum displacement, compared to the case where an oscillation waveform is a sine wave.

The fast descending speed of the mold makes the amount of the molten powder that is pushed (pumped) into a space between the mold and the solidified shell increase. The fast ascending speed of the mold makes the powder possible to reach closer area to the inner wall surface of the mold (makes it possible to broaden the flow path of the powder). The long time when change in the movement speed of the mold in the vicinity of the maximum displacement is small makes it possible to keep the state where the flow path of the powder broadens long. Therefore, the lubricity between the mold and the solidified shell can be improved by vertical oscillation of the mold with any composite waveform shown in FIGS. 3 to 5.

The displacement of the mold in the case of t=0 is at the middle position between the maximum displacement (2 mm) and the minimum displacement (−2 mm), that is, at a neutral position in every composite waveform shown in FIGS. 3 to 5. Whereby, troubles at the initial stage of casting such as seal leakage can be prevented. The neutral position does not shift. So, the effect of suppressing poor lubrication in the mold and involvement of the powder into the molten steel can be stably brought about.

While the lubricity between the mold and the solidified shell can be more improved as the non-sine coefficient b is larger, some kinds of physical properties of the powder cause the molten powder to be easily involved into the molten steel. In view of the above, preferably, a proper value of the non-sine coefficient b is employed according to physical properties of powder, or powder of proper physical properties is employed correspondingly to the value of the non-sine coefficient b. For example, when the value of the non-sine coefficient b is large, involvement of the molten powder into the molten steel can be suppressed efficiently if powder of a high solidification point, and in a molten state, of high viscosity is employed.

Difference in performance of the lubricity of powder of different oscillation waveforms were examined. As oscillation waveforms, a sine wave, the waveform shown in FIG. 3 (b=0.15) and the waveform shown in FIG. 5 (b=0.25) were used. Continuous casting was carried out as a mold oscillated vertically with each waveform using an electro-hydraulic oscillator. The powder of the same properties (solidification point: 1154° C., viscosity of the molten powder at 1300° C.: 0.14 Pa·s) was used for every case where the mold oscillated with the above mentioned oscillation waveform. Load when the mold oscillated, which was the maximum load during the time when the mold ascended (hereinafter simply referred to as "max load"), was measured by the above electro-hydraulic oscillator.

The performance of the lubricity was evaluated by the maximum frictional force. The maximum frictional force F was represented by $$F=(L1-L2)/S,$$

where L1 is the max load at the casting (when the molten steel existed in the mold);

L2 is the max load when the casting was not carried out (when the molten steel did not exist in the mold; and S is an area of a part that touched or faced the molten steel in the inner face of the mold.

Figure 6:
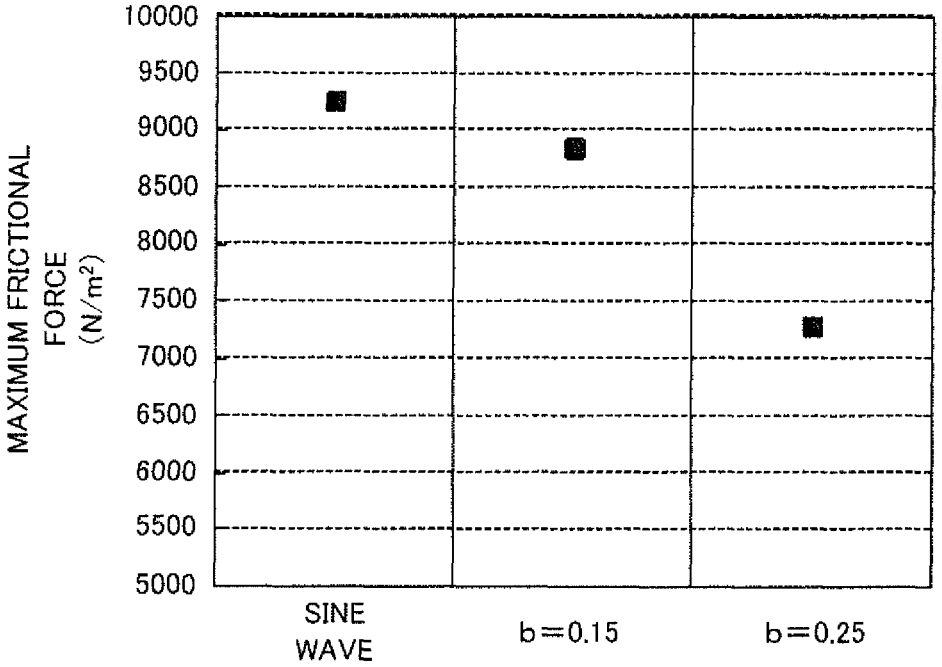
FIG. 6 shows the maximum frictional force per oscillation waveform.

FIG. 6 shows the maximum frictional force for the oscillation waveforms. The maximum frictional force is small in the case the waveforms shown in FIGS. 3 and 5 were used as oscillation waveforms compared to the case where the sine wave is used. That is, the performance of the lubricity of the powder between the mold and the solidified shell was high in the case where the waveform of the formula (1) (b=0.15, 0.25) compared to the case where the sine wave was used. The performance of the lubricity was higher in the case of b=0.25 than the case of b=0.15.

REFERENCE SIGNS LIST

3 . . . mold
20 . . . oscillator

The invention claimed is:

1. A method for operating a continuous casting machine where a slab is withdrawn from a mold for continuous casting while the mold is oscillated in a vertical direction, the method comprising:

oscillating the mold so as to satisfy the following formula (2) with an oscillation waveform represented by the following formula (1):

[Math. 1]

$$r(t) = (S/2)\{\sin(\omega t + \varphi) + b\cos 2(\omega t + \varphi) + b\} \quad (1)$$

$$\varphi = \pm\tan^{-1}\left\{\frac{1}{\sqrt{2}}\sqrt{(1+16b^2)-1}\right\} \quad (2)$$

wherein r(t) is displacement of the mold (mm),
S is an oscillation stroke of the mold (mm),
ω is angular velocity (=2πf) (rad/s),
f is oscillation frequency of the mold (Hz),
t is time(s),
φ is the initial phase (rad), and
b is a non-sine coefficient (0<b≤0.25).

2. The method for operating a continuous casting machine according to claim 1, wherein 0.15≤b.

* * * * *